US008265830B2

(12) United States Patent
Mizutani

(10) Patent No.: US 8,265,830 B2
(45) Date of Patent: Sep. 11, 2012

(54) STEERING CONTROL METHOD, STEERING CONTROL DEVICE, AND WATERCRAFT

(75) Inventor: Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 675 days.

(21) Appl. No.: 12/238,507

(22) Filed: Sep. 26, 2008

(65) Prior Publication Data

US 2009/0088927 A1 Apr. 2, 2009

(30) Foreign Application Priority Data

Sep. 28, 2007 (JP) ..... 2007-254113
Oct. 1, 2007 (JP) ..... 2007-257281

(51) Int. Cl.

| | |
|---|---|
| ***A01B 69/00*** | (2006.01) |
| ***B60L 11/00*** | (2006.01) |
| ***B63H 25/02*** | (2006.01) |
| ***B63H 25/06*** | (2006.01) |
| ***B63H 5/20*** | (2006.01) |

(52) U.S. Cl. ..... 701/42; 701/22; 114/144; 114/162; 440/53

(58) Field of Classification Search ..... None
See application file for complete search history.

(56) References Cited

U.S. PATENT DOCUMENTS

| | | | | |
|---|---|---|---|---|
| 7,160,158 | B2 * | 1/2007 | Kinoshita | 440/1 |
| 7,422,496 | B2 * | 9/2008 | Mizutani | 440/1 |
| 2005/0009419 | A1 * | 1/2005 | Kinoshita | 440/87 |
| 2007/0066154 | A1 * | 3/2007 | Mizutani | 440/1 |
| 2007/0155258 | A1 * | 7/2007 | Kaji | 440/87 |
| 2009/0117788 | A1 * | 5/2009 | Kaji | 440/1 |

FOREIGN PATENT DOCUMENTS

| | | | |
|---|---|---|---|
| EP | 1 770 008 | A2 | 4/2007 |
| JP | 2959044 | B2 | 10/1999 |
| JP | 2006-199239 | A | 8/2006 |
| JP | 2007-091213 | A | 4/2007 |

OTHER PUBLICATIONS

Official Communication issued in corresponding Japanese Patent Application No. 2007-254113, drafted on Feb. 24, 2012.

* cited by examiner

*Primary Examiner* — Thomas Tarcza
*Assistant Examiner* — Nagi Murshed
(74) *Attorney, Agent, or Firm* — Keating & Bennett, LLP

(57) ABSTRACT

A watercraft includes an operating method in which a present steering wheel rotational angle is detected, and a steering wheel rotational angle variation is calculated by subtracting a steering wheel rotational angle in a preceding control period from the steering wheel rotational angle. Next, a steering angle ratio is set. A target steering angle variation is calculated by multiplying the steering wheel rotational angle variation by the steering angle ratio. Finally, a target steering angle in a present period is calculated by adding the target steering angle variation to a target steering angle in a preceding control period. A steering device is steered based on the target steering angle. The operating method operates to prevent a rider of a watercraft from feeling uncomfortable in the watercraft which has an electric steering mechanism when either a steering wheel or a steering device is turned in a state when a power supply is turned off or a case when steering wheel rotational angles of a plurality of operating stations differ from each other.

9 Claims, 14 Drawing Sheets

STEERING CONTROL METHOD, STEERING CONTROL DEVICE, AND WATERCRAFT

BACKGROUND OF THE INVENTION

1. Field of the Invention

The present invention relates to a steering control method, a steering control device, and a watercraft including an electric steering mechanism, for example, a steer-by-wire type steering mechanism.

2. Description of the Related Art

FIGS. 11 through 14C show a steering control method related to the present invention.

A steering wheel and a steering device, such as an outboard motor main body, are electrically connected together in a watercraft including an electric steering mechanism. As shown in FIG. 11, steering operation is controlled in a manner such that a target steering angle of the steering device is set in accordance with a steering wheel rotational angle.

More specifically, a steering wheel rotational angle $\theta_h$ is computed based on a detection signal of a steering wheel rotational angle sensor (step S41). A steering angle ratio K corresponding to a watercraft speed is set (step S42). The steering wheel rotational angle $\theta_h$ is multiplied by the steering angle ratio K, and a target steering angle $\theta_{s*}$ ($=K\cdot\theta_h$) is obtained (step S43). The steering device is instructed to make a steering operation based on the target steering angle $\theta_{s*}$ (step S44). The steering device operates in a manner such that an actual steering angle $\theta_s$ corresponds to the target steering angle $\theta_{s*}$ (step S45).

The steering angle ratio K is a ratio of the target steering angle $\theta_{s*}$ to the steering wheel rotational angle $\theta_h$ and is a constant value depending on the watercraft speed. For example, in the case where the steering angle ratio K is 1/24, the steering device steers 15° for each rotation (a 360° rotation) of the steering wheel.

However, an inconvenience may occur with such a steering control method because the target steering angle $\theta_{s*}$ is set based on the steering wheel rotational angle $\theta_h$.

First, the watercraft includes an electric steering mechanism, and thus the steering wheel can be turned to a different rotational position independently of the steering device when the power supply is turned off, for example, in safekeeping the watercraft on water, on land, and so forth. Conversely, the steering device can be turned to a different steering position independently of the steering wheel. In these cases, the actual steering angle $\theta_s$ may be offset from the steering wheel rotational angle $\theta_h$ and in turn the target steering angle $\theta_{s*}$. This may result in a circumstance that the steering wheel and the steering device suddenly turn to prescribed positions (positions that the steering wheel rotational angle $\theta_h$ corresponds to the actual angle $\theta_s$) as soon as the power supply is turned on and a rider of the watercraft will feel uncomfortable.

More specifically, for example, when the steering wheel has been turned and the steering wheel rotational angle $\theta_h$ has become $\theta_1$, even though the steering device has not been steered in a state where the power supply is turned off (a state before starting) as indicated in FIG. 12A, if the power supply is then turned on at time $t_1$ and the watercraft is started as indicated in FIG. 12C, the steering wheel may suddenly turn so that the steering wheel rotational angle $\theta_h$ decreases from $\theta_1$ to $\theta_2$. Therefore, the rider of the watercraft may feel uncomfortable. Furthermore, for example, in the case where the steering device has been steered and the actual steering angle $\theta_s$ has become $\theta_3$ although the steering wheel has not been turned in the state where the power supply was turned off (the state before starting) as indicated in FIG. 12B, if the power supply is then turned on at time $t_1$ and the watercraft is started as indicated in FIG. 12C, the steering device may be suddenly steered so that the actual steering angle increases from $\theta_3$ to $\theta_4$. This may cause the rider of the watercraft feel uncomfortable.

Second, in the case where the watercraft has a plurality of operating stations (for example, cockpits) and the steering wheel rotational angles $\theta_h$ of these operating stations differ from each other, the steering device may be suddenly steered in response to a change in the control systems immediately after the operating stations are changed, and this could cause the rider of the watercraft to feel uncomfortable.

More specifically, for example, in the case where the steering wheel rotational angle $\theta_h$ of a first operating station is $\theta_5$ and the steering wheel rotational angle $\theta_h$ of a second operating station is $\theta_6$ (which is $<\theta_5$) as indicated in FIG. 13B, if the active operating station is changed from the first operating station to the second operating station at time $t_2$ as indicated in FIG. 13A, the target steering angle $\theta_{s*}$ could decrease in response to a decrease in the steering wheel rotational angle $\theta_h$ from $\theta_5$ to $\theta_6$. Therefore, the steering device may be steered suddenly since the actual steering angle decreases from $\theta_7$ to $\theta_8$ as indicated in FIG. 13C. As a result, the rider of the watercraft may feel uncomfortable.

Third, in the case where a steering angle ratio varying function (a function that the steering angle ratio is varied in accordance with watercraft speed to enhance safety during traveling) is installed in the watercraft, if the watercraft speed is changed, a steering angle corresponding to a counter-steering may suddenly change although the steering wheel is not turned. This could result in the rider feeling uncomfortable.

More specifically, for example, in the case where the watercraft is traveling at a constant speed $v_1$, starts decelerating at time $t_3$, attains a speed $v_2$ at time $t_4$ to finish decelerating, and thereafter travels at a constant speed $v_2$ as indicated in FIG. 14C, the steering wheel rotational angle $\theta_h$ may be retained at a constant value $\theta_9$ through all steps of the traveling as indicated in FIG. 14A. However, the actual steering angle $\theta_s$ starts increasing from $\theta_{10}$ after a deceleration starting time $t_3$, and the actual steering angle $\theta_s$ could reach $\theta_{11}$ at a deceleration finishing time $t_4$ as indicated in FIG. 14B. As a result of this, the rider of the water craft may feel uncomfortable.

SUMMARY OF THE INVENTION

Preferred embodiments of the present invention provide a steering control method, a steering control device, and a watercraft that are capable of preventing a circumstance where a rider of the watercraft from feeling uncomfortable in a case where either a steering wheel or a steering device turns in a state when a power supply is turned off causing steering wheel rotational angles of a plurality of operating stations to differ from one another, or that a watercraft speed is changed in a watercraft including a steering angle ratio varying function.

A first preferred embodiment of the present invention provides a steering control method for a watercraft in which a steering wheel and a steering device are electrically connected together, a steering wheel rotational angle variation of the steering wheel is computed, a target steering angle is calculated based on the steering wheel rotational angle variation, and the steering device is steered based on the target steering angle.

A second preferred embodiment of the present invention provides a steering control device for a watercraft in which a steering wheel and a steering device are electrically connected together, including a rotational angle variation computing device arranged to compute a steering wheel rotational angle variation of the steering wheel, a target steering angle computing device arranged to calculate a target steering angle based on the steering wheel rotational angle variation computed by the rotational angle variation computing device, and a steering device operating device arranged to steer the steering device based on the target steering angle calculated by the target steering angle computing device.

A third preferred embodiment of the present invention provides the steering control device in accordance with the second preferred embodiment, in which the rotational angle variation computing device computes the steering wheel rotational angle variation based on a present steering wheel rotational angle and a steering wheel rotational angle in one or more previous control periods.

A fourth preferred embodiment of the present invention provides the steering control device in accordance with the second preferred embodiment, in which the rotational angle variation computing device computes the steering wheel rotational angle variation by integrating steering wheel angular speed over time.

A fifth preferred embodiment of the present invention provides a watercraft including the steering control device in accordance with any of the second through fourth preferred embodiments.

A sixth preferred embodiment of the present invention provides a steering control method for a watercraft in which a steering wheel and a steering device are electrically connected together, a target steering speed is set in response to a rotational state of the steering wheel, and the steering device is steered at the target steering speed.

A seventh preferred embodiment of the present invention provides a steering control device for a watercraft in which a steering wheel and a steering device are electrically connected together, including a steering speed setting device arranged to set a target steering speed in response to a rotational state of the steering wheel, and a steering device operating device arranged to steer the steering device at the target steering speed set by the steering speed setting device.

An eighth preferred embodiment of the present invention provides the steering control device in accordance with the seventh preferred embodiment, in which the steering speed setting device sets the target steering speed in proportion to a steering wheel angular speed of the steering wheel.

A ninth preferred embodiment of the present invention provides a watercraft including the steering control device in accordance with the seventh or the eighth preferred embodiment of the present invention.

In the first preferred embodiment of the present invention, the target steering angle which is to be a reference in steering the steering device is calculated based on the steering wheel rotational angle variation. Therefore, if only one of the steering wheel or the steering device turns in the state where the power supply is turned off, a circumstance that the steering wheel and/or the steering device suddenly turn to prescribed positions as soon as power supply is turned on when the watercraft is started will be prevented such that the rider of the watercraft will be prevented from feeling uncomfortable. Furthermore, if the watercraft includes a plurality of operating stations and rotational angles of both of the steering wheels differ from each other, a circumstance that the steering device is steered immediately after a change between the operating stations will be prevented and the rider of the watercraft is prevented from feeling uncomfortable. Therefore, it is possible to provide a steering control method that can prevent an occurrence of a circumstance where the rider feels uncomfortable in the case where either the steering wheel or the steering device turns in the state that power supply is turned off, or that steering wheel rotational angles of the plurality of operating stations differ from each other.

In the second through fourth preferred embodiments of the present invention, the target steering angle which is to be a reference in steering the steering device can be calculated based on a variation of the steering wheel rotational angle. Therefore, if either the steering wheel or the steering device turns in the state where the power supply is turned off, a circumstance where the steering wheel and/or the steering device suddenly turn to prescribed positions as soon as power supply is turned on when the watercraft is started will be prevented and the rider will not feel uncomfortable. Additionally, if the watercraft includes a plurality of operating stations and steering wheel rotational angles of both the operating stations differ from each other, a circumstance where the steering device is suddenly steered immediately after a change between the operating stations is prevented and the rider of the watercraft is prevented from feeling uncomfortable. Therefore, it is possible to provide a steering control device that can prevent the rider from feeling uncomfortable in the case where either the steering wheel or the steering device turns in the state that power supply is turned off or that steering wheel rotational angles of the plurality of operating stations differ from each other.

The fifth preferred embodiment of the present invention provides a watercraft having the same effects as the second through fourth preferred embodiments of the present invention.

In the sixth preferred embodiment of the present invention, the steering device is steered at a target steering speed set in response to a rotational state of the steering wheel. Therefore, if only one of the steering wheel or the steering device turns in the state that power supply is turned off, a circumstance where the steering wheel and/or the steering device suddenly turn to prescribed positions as soon as power supply is turned on when the watercraft is started can be prevented so that the rider will not feel uncomfortable. In addition, if the watercraft includes a plurality of operating stations and steering wheel rotational angles of the operating stations differ from each other, a circumstance where the steering device is suddenly steered immediately after a change between the operating stations can be prevented such that the rider of the watercraft will not feel uncomfortable. Further, if a watercraft speed is changed in which the steering angle ratio varying function is installed in the watercraft, a circumstance where a steering angle corresponding to a counter-steering is suddenly changed can be prevented so that the rider of the watercraft will not feel uncomfortable. Accordingly, it is possible to provide a steering control method that can prevent an occurrence of the circumstance that the rider feels uncomfortable in a case where only one of the steering wheel or the steering device turns in the state that power supply is turned off, that steering wheel rotational angles of the plurality of operating stations differ from each other, or further in a case that the watercraft speed is changed in the watercraft including the steering angle ratio varying function.

In the seventh preferred embodiment of the present invention, the steering device can be steered at the target steering speed set in response to a rotational state of the steering wheel. Therefore, if either the steering wheel or the steering device turns in the state that power supply is turned off, a circumstance that the steering wheel and/or the steering device suddenly turn to prescribed positions as soon as power supply is turned on when the watercraft is started can be prevented so that the rider will not feel uncomfortable. In addition, if the watercraft includes a plurality of operating stations and steering wheel rotational angles of the operating stations differ from each other, a circumstance that the steering device is suddenly steered immediately after a change between the operating stations can be prevented so that the rider of the watercraft will not feel uncomfortable. Furthermore, if the watercraft speed is changed in the case where the steering angle ratio varying function is installed in the watercraft, a circumstance that a steering angle corresponding to a counter-steering is suddenly changed can be prevented such that the rider of the watercraft will not feel uncomfortable. Accordingly, it is possible to provide a steering control device that can prevent an occurrence of the circumstance where the rider feels uncomfortable in the case where either the steering wheel or the steering device turns in the state that the power supply is turned off, that steering wheel rotational angles of the plurality of operating stations differ from each other, or further in the case that the watercraft speed is changed in the watercraft including the steering angle ratio varying function.

In the eighth preferred embodiment of the present invention, the steering device can be steered at the target steering speed in proportion to the steering wheel angular speed. Therefore, if either the steering wheel or the steering device turns in the state that the power supply is turned off, a circumstance that the steering wheel and/or the steering device suddenly turn to prescribed positions as soon as power supply is turned on when the watercraft is started can be prevented so that the rider will not feel uncomfortable. In addition, if the watercraft includes a plurality of operating stations and steering wheel rotational angles of the operating stations differ from each other, a circumstance that the steering device is suddenly steered immediately after a change between the operating stations can be prevented so that the rider will not feel uncomfortable. Further, if a watercraft speed is changed in the case where the steering angle ratio varying function is installed in the watercraft, a circumstance where a steering angle corresponding to a counter-steering is suddenly changed can be prevented so that the rider will not feel uncomfortable. Accordingly, it is possible to provide a steering control device that can prevent an occurrence of the circumstance where the rider feels uncomfortable in the case where only one of the steering wheel or the steering device turns in the state that the power supply is turned off, that steering wheel rotational angles of the plurality of operating stations differ from each other, or further in the case that a watercraft speed is changed in the watercraft including the steering angle ratio varying function.

The ninth preferred embodiment of the present invention provides a watercraft having the same effects as the second or third preferred embodiments of the present invention.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIGS. 4A and 4B are graphs indicating states before and after starting the watercraft in a case that only one of a steering wheel or an outboard motor main body is turned in a state that the power supply is turned off in the steering control method in accordance with the first preferred embodiment, in which FIG. 4A is a graph indicating change in the steering wheel rotational angle with respect to time, FIG. 4B is a graph indicating change in the actual steering angle with respect to time.

FIGS. 5A and 5B are graphs indicating states before and after change between operating stations in a case that steering wheel rotational angles of the two operating stations differ from each other in the steering control method in accordance with the first preferred embodiment, in which FIG. 5A is a graph indicating change between the operating stations, FIG. 5B is a graph indicating change in the steering wheel rotational angle with respect to time, and FIG. 5C is a graph showing change in the actual steering angle with respect to time.

FIGS. 10A, 10B, and 10C are graphs indicating states before and after deceleration in a case that a steering angle ratio varying function operates in the steering control method in accordance with the first preferred embodiment, in which FIG. 10A is a graph indicating change in the steering wheel rotational angle with respect to time, FIG. 10B is a graph indicating change in the actual steering angle with respect to time, and FIG. 10C is a graph indicating change in the speed of the watercraft with respect to time.

FIGS. 12A, 12B, and 12C are graphs indicating states before and after starting a watercraft in a case that only one of a steering wheel or an outboard motor main body is turned in a state that the power supply is turned off in a steering control method, in which FIG. 12A is a graph indicating change in the steering wheel rotational angle with respect to time, FIG. 12B is a graph indicating change in the actual steering angle with respect to time, and FIG. 12C is a graph indicating an ON/OFF state of the power supply.

FIGS. 13A, 13B, and 13C are graphs indicating states before and after a change between operating stations in a case that the steering wheel rotational angles of the two operating stations differ from each other in the steering control method, in which FIG. 13A is a graph indicating a change between the operating stations, FIG. 13B is a graph indicating change in the steering wheel rotational angle with respect to time, and FIG. 13C is a graph indicating change in the actual steering angle with respect to time.

FIGS. 14A, 14B, and 14C are graphs indicating states before and after deceleration in a case that a steering angle ratio varying function operates in the steering control method, in which FIG. 14A is a graph indicating change in the steering wheel rotational angle with respect to time, FIG. 14B is a graph indicating change in the actual steering angle with respect to time, and FIG. 14C is a graph indicating change in the speed of a watercraft with respect to time.

DETAILED DESCRIPTION OF THE PREFERRED EMBODIMENTS

Preferred embodiments of the present invention will be described hereinafter.

First Preferred Embodiment

FIGS. 1 through 5 show a first preferred embodiment of the present invention.

Figure 1:
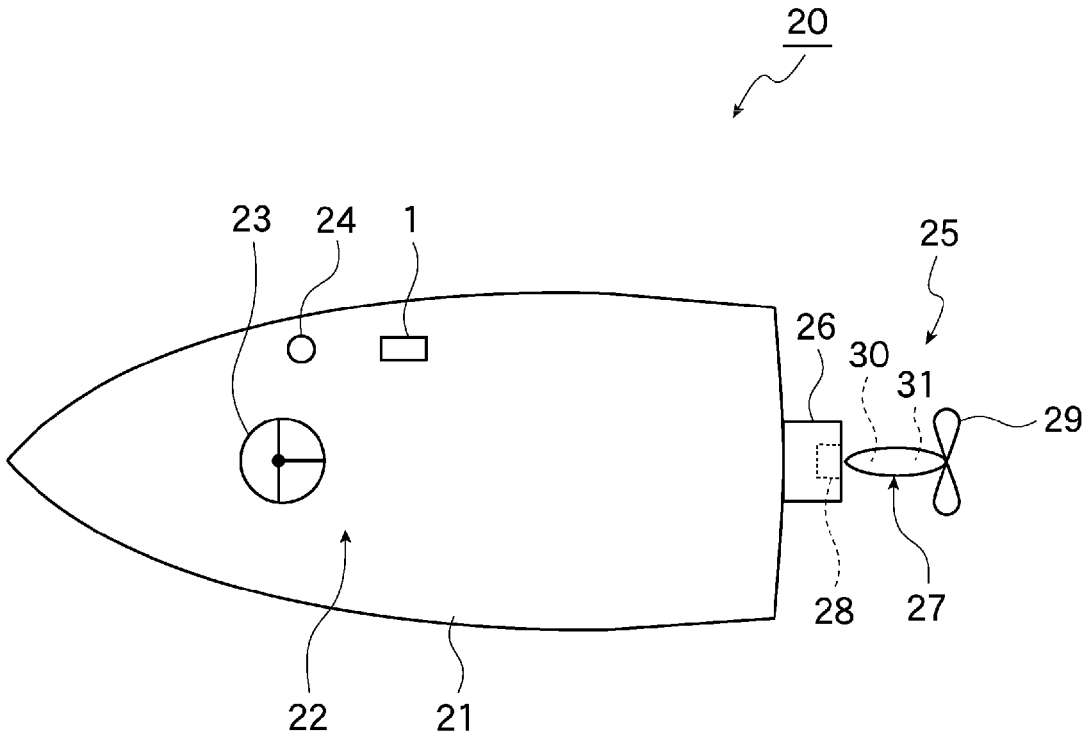
FIG. 1 is a plan view of a watercraft in accordance with a first preferred embodiment of the present invention.

A construction of the first preferred embodiment of the present invention will be described first. As shown in FIG. 1, a watercraft 20 has a hull 21. An operating station 22 is provided at a general center of the hull 21. A steering wheel 23 is rotatably supported in the operating station 22 in the clockwise and the counterclockwise directions. A steering wheel rotational angle sensor 24 is mounted on the steering wheel 23. An outboard motor 25 is removably mounted on a rear portion (stern) of the hull 21. The outboard motor 25 is provided with a bracket 26, an outboard motor main body 27 including a propulsion unit, and a steering device operating system 28 such as a steering motor. The bracket 26 is fixed to the rear portion of the hull 21. The outboard motor main body 27 is supported by the bracket 26 in a manner such that it is steered to the right or the left around a steering shaft and thereby a direction of propulsion can be changed. Further, the outboard motor main body 27 is provided with an engine 30, a drive transmission mechanism 31, and a propeller 29, for example. Driving force of the engine 30 is transmitted to the propeller 29 via the drive transmission mechanism 31 thereby rotating the propeller 29, and generating a propulsive force. An electric steering mechanism is provided on the watercraft 20. The steering wheel 23 and the steering device operating system 28 are electrically connected together.

Figure 2:
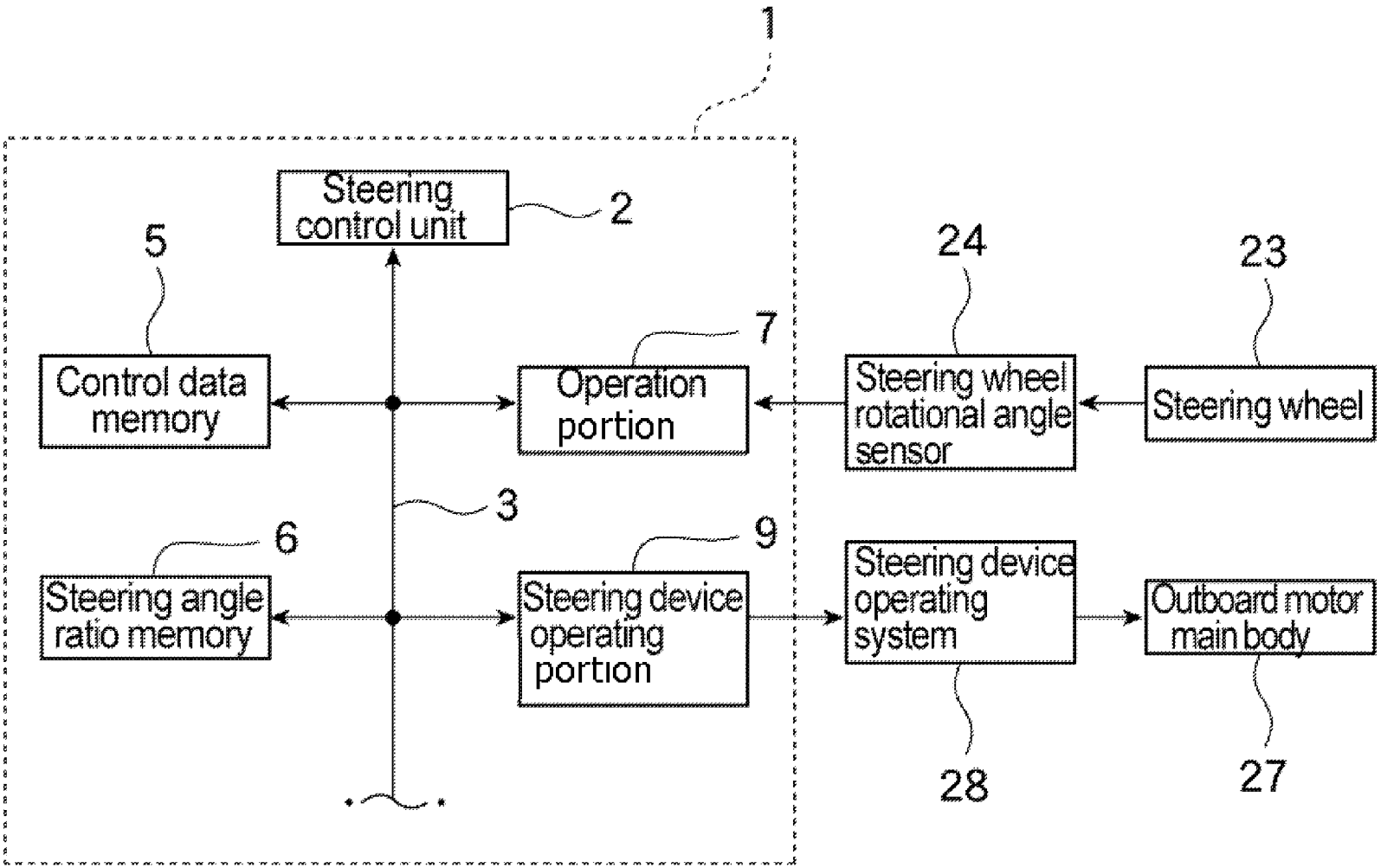
FIG. 2 is a control block diagram showing a steering control device in accordance with the first preferred embodiment of the present invention.
Figure 3:
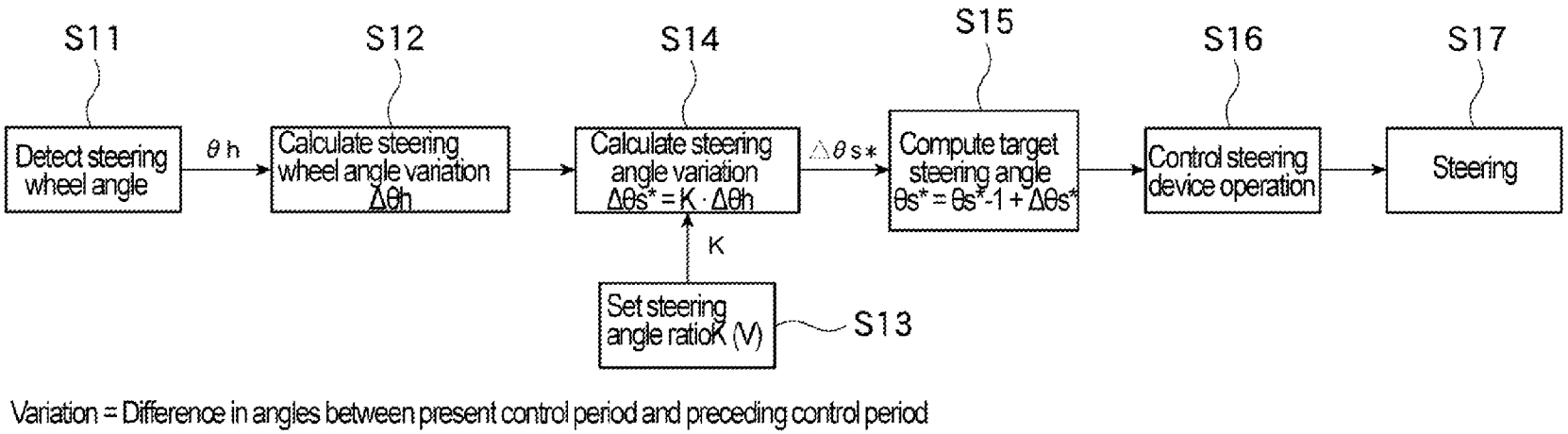
FIG. 3 is a flowchart showing a steering control method in accordance with the first preferred embodiment of the present invention.

As shown in FIG. 1, a steering control device 1 is installed in the watercraft 20. As shown in FIG. 2, the steering control device 1 has a steering control unit 2, such as a CPU (Central Processing Unit), and a control data memory 5, a steering angle ratio memory 6, an operation portion 7, and a steering device operating portion 9 are connected to the steering control unit 2 via a bus line 3. The steering angle ratio memory 6 stores a steering angle ratio K such that the steering angle ratio K can be read out in response to a watercraft speed. Further, the steering wheel rotational angle sensor 24 is connected to the operation portion 7. The steering device operating system 28 is connected to the steering device operating portion 9.

Next, an operation of the first preferred embodiment of the present invention will be described.

A rider of the watercraft appropriately turns the steering wheel 23 at the operating station 22 when operating the watercraft 20 having the construction described above. Then, the steering control unit 2 executes a steering control while performing steps S11 through S17 shown in FIG. 3 for every prescribed control period (for example, a 5 ms prescribed control period).

More specifically, the steering control unit 2 instructs the operation portion 7 to calculate a target steering angle $\theta_{s*}$. Receiving this instruction, the operation portion 7 calculates the target steering angle $\theta_{s*}$ from a target steering angle variation $\theta_{s*}$ proportional to a steering wheel rotational angle variation $\Delta\theta_h$ as described below. The target steering angle will be expressed as "$\theta_{s*}$". A symbol "*" is added to "$\theta_s$" to distinguish it from an actual steering angle $\theta_s$ (an actual angle of the outboard motor main body 27), which will be described later.

First, the operation portion 7 computes a present steering wheel rotational angle $\theta_{h1}$ based on a detection signal of the steering wheel rotational angle sensor 24 (step S11). The operation portion 7 reads out a steering wheel rotational angle $\theta_{h2}$ in a preceding control period from the control data memory 5, subtracts the steering wheel rotational angle $\theta_{h2}$ in the preceding control period from the present steering wheel rotational angle $\theta_{h1}$, and obtains the steering wheel rotational angle variation $\Delta\theta_h$ ($=\theta_{h1}-\theta_{h2}$) (step S12). Further, the operation portion 7 stores the present steering wheel rotational angle $\theta_{h1}$ in the control data memory 5 for the next steering control. However, there is no steering control in a preceding control period in the first, initial steering control, and thus the steering wheel rotational angle variation $\Delta\theta_h$ cannot be calculated. Therefore, only a present steering wheel rotational angle $\theta_{h1}$ is computed based on a detection signal of the steering wheel rotational angle sensor 24, and the steering wheel rotational angle $\theta_{h1}$ is stored in the control data memory 5.

Next, the operation portion 7 reads out and sets the steering angle ratio K corresponding to a present watercraft speed (for example, K=1/24) from the steering angle ratio memory 6 (step S13). The operation portion 7 calculates the target steering angle variation $\Delta\theta_{s*}$ ($=K\cdot\Delta\theta_h$) by multiplying the steering wheel rotational angle variation $\Delta\theta_h$ by the steering angle ratio K (step S14). However, the target steering angle variation $\Delta\theta_{s*}$ cannot be calculated in the first steering control since the steering wheel rotational angle variation $\Delta\theta_h$ has not been calculated as described above. Therefore, these steps (steps S13 and S14) are skipped for the first steering control.

Finally, the operation portion 7 reads out a target steering angle $\theta_{s*-1}$ in a preceding control period from the control data memory 5, adds the target steering angle variation $\Delta\theta_{s*}$ to the target steering angle $\theta_{s*}$_1, and obtains a present target steering angle $\theta_{s*}$ ($=\theta_{s*-1}+\Delta\theta_{s*}$) (step S15). Furthermore, the operation portion 7 stores the present target steering angle $\theta_{s*}$ as $\theta_{s*-1}$ in the control data memory 5 for the next steering control. However, the target steering angle variation $\theta_{s*}$ cannot be calculated in the first steering control since the target steering angle variation $\Delta\theta_{s*}$ has not been calculated as described above. Therefore, this step (step S15) is skipped for the first steering control.

When the target steering angle $\theta_{s*}$ is calculated through such steps, the steering control unit 2 instructs the steering device operating portion 9 to make a steering operation of the outboard motor main body 27 based on the target steering angle $\theta_{s*}$ (step S16). Receiving this instruction, the steering device operating portion 9 appropriately operates the steering device operating system 28, and thereby steers the outboard motor main body 27 in a manner such that the actual steering angle $\theta_s$ corresponds to the target steering angle $\theta_{s*}$ (step S17). However, the instruction on the steering operation to the outboard motor main body 27 is not output in the first steering control since the target steering angle $\theta_{s*}$ has not been calculated as described above. Accordingly, the steering operation of the outboard motor main body 27 is not made for the first steering control.

The steering control composed of a series of the steps (steps S11 through S17) is repeated. Accordingly, the steering operation of the outboard motor main body 27 is continuously executed.

The target steering angle $\theta_{s*}$ is set based on the steering wheel rotational angle variation $\Delta\theta_h$ as described above. Therefore, the outboard motor main body 27 is steered in response to an angle at which the steering wheel 23 is turned independently of an initial position of the steering wheel 23. As a result, the steering wheel rotational angle variation $\Delta\theta_h$ is zero while the steering wheel 23 is not turned, the target steering angle variation $\Delta\theta_{s*}$ is also zero, and thus the outboard motor main body 27 is not steered.

Therefore, if only one of the steering wheel 23 or the outboard motor main body 27 turns in the state that the power supply is turned off, a circumstance that the steering wheel 23 and/or the outboard motor main body 27 suddenly turns to prescribed positions just as the power supply is turned on when the watercraft 20 is started can be prevented so that the rider will not feel uncomfortable.

Figure 4A:
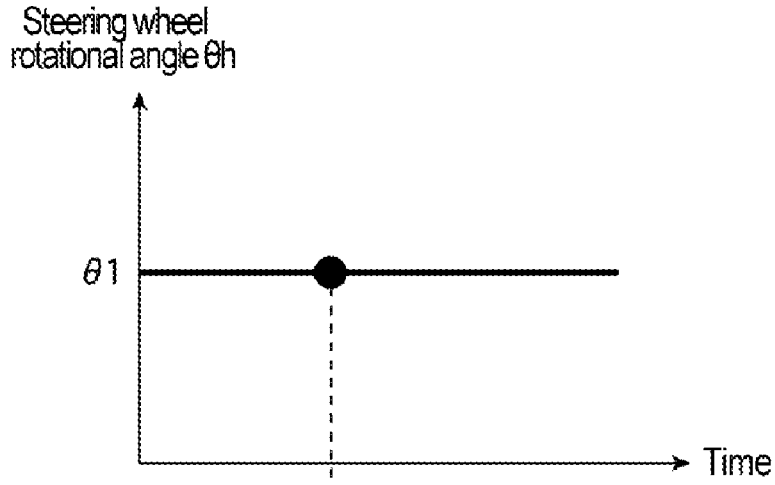
Figure 4B:
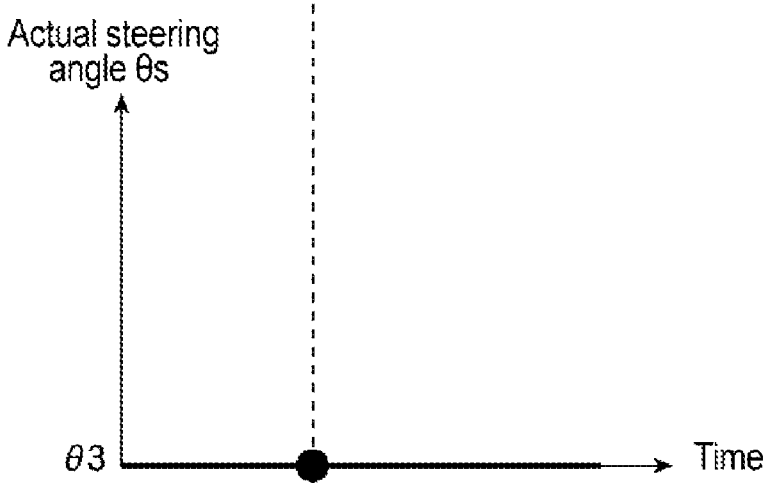
Figure 4C:
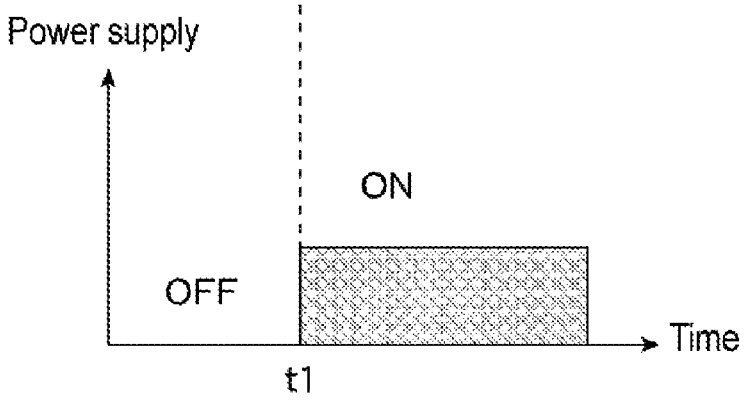
FIG. 4C is a graph indicating an ON/OFF state of the power supply.

More specifically, for example, in the case where the outboard motor main body 27 has not been steered, the steering wheel 23 has been turned, and the steering wheel rotational angle $\theta_h$ has become $\theta_1$ in the state that the power supply is turned off (the state before starting) as indicated in FIG. 4A, if power supply is turned on at time $t_1$ and the watercraft is started as indicated in FIG. 4C, the steering wheel rotational angle $\theta_h$ is retained at $\theta_1$ and the steering wheel does not suddenly turn. Therefore, a circumstance where the steering wheel 23 suddenly turns as soon as the power supply is turned on can be prevented so that the rider will not feel uncomfortable. In the case where the steering wheel 23 has not been turned, the outboard motor main body 27 is turned, and the actual steering angle $\theta_s$ has become $\theta_3$ in the state that the power supply is turned off (the state before starting) as indicated in FIG. 4B, if power supply is turned on at time $t_1$ and the watercraft 20 is started as indicated in FIG. 4C, the actual steering angle $\theta_s$ is retained at $\theta_3$, and the outboard motor main body 27 is not suddenly steered. Therefore, a circumstance where the outboard motor main body 27 is suddenly steered as soon as the power supply is turned on when the watercraft 20 is started can be prevented so that the rider will not feel uncomfortable.

Further, in the case where the watercraft 20 includes two operating stations 22 and steering wheel rotational angles $\theta_h$ of both the operating stations 22 differ from each other, a circumstance that the outboard motor main body 27 is suddenly steered immediately after a change between the operating stations 22 can be prevented so that the rider will not feel uncomfortable.

Figures 5A, 5B, 5C:
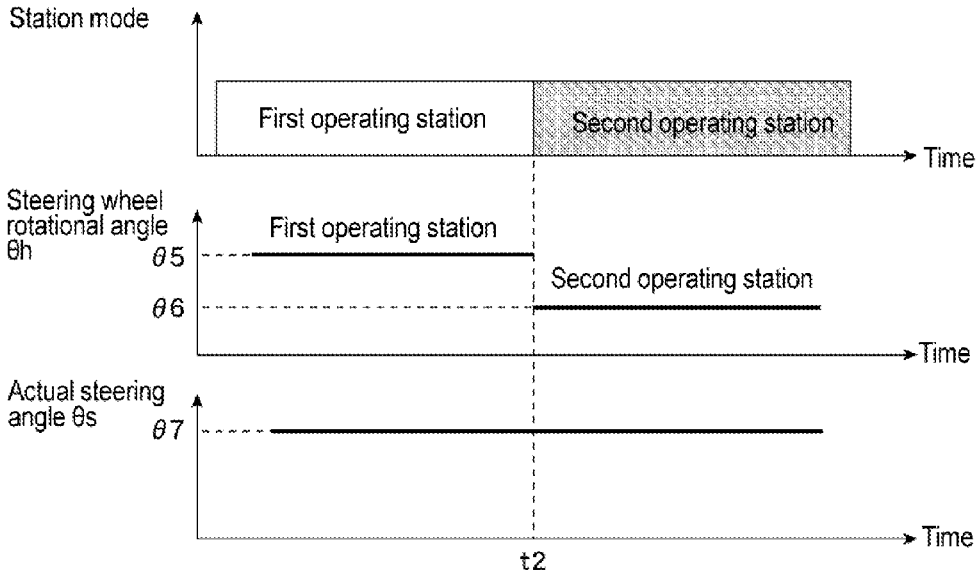

More specifically, for example, in the case where the steering wheel rotational angle $\theta_h$ of the first operating station is $\theta_5$ and the steering wheel rotational angle $\theta_h$ of the second operating station is $\theta_6$ (which is $<\theta_5$) as indicated in FIG. 5B, even if an active operating station is changed from the first operating station to the second operating station at time $t_2$ and control systems are changed as indicated in FIG. 5A, the actual steering angle $\theta_s$ is retained at $\theta_7$ and the outboard motor main body 27 is not suddenly steered as indicated in FIG. 5C. Therefore, a circumstance where the outboard motor main body 27 is suddenly steered immediately after a change between the operating stations 22 can be prevented so that the rider will not feel uncomfortable.

Second Preferred Embodiment

Figure 6:
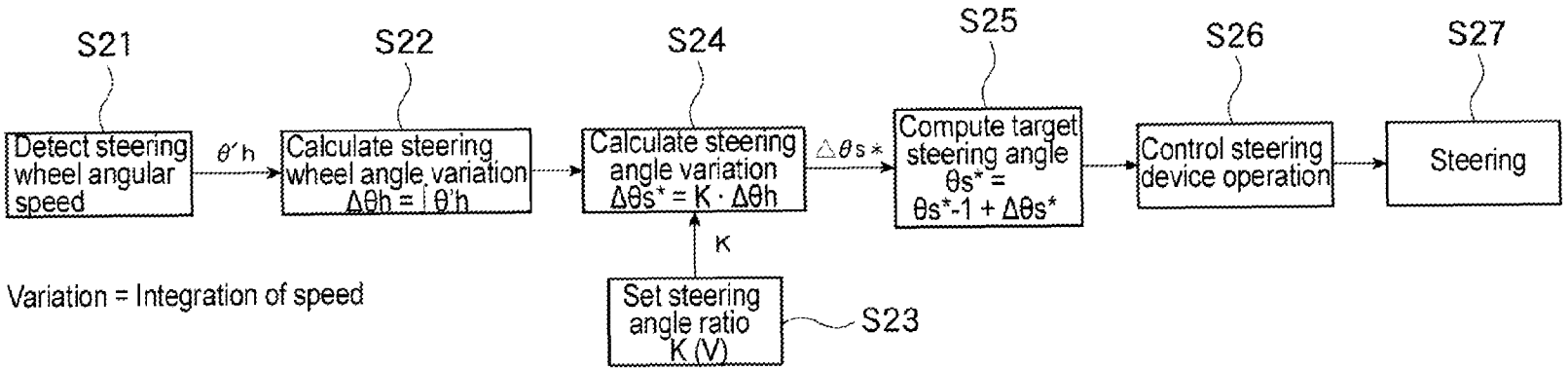
FIG. 6 is a flowchart showing a steering control method in accordance with a second preferred embodiment of the present invention.

FIG. 6 shows a second preferred embodiment of the present invention.

A watercraft 20 in accordance with the second preferred embodiment has the same construction compared to the above first preferred embodiment except that a steering wheel angular speed sensor (not shown) such as an encoder is provided instead of the steering wheel rotational angle sensor 24.

Next, operation of a watercraft in accordance with the second preferred embodiment of the present invention will be described.

A rider of the watercraft appropriately turns the steering wheel 23 at the operating station 22 when the rider operates the watercraft 20 having the above construction. Then, the steering control unit 2 executes a steering control while performing steps S21 through S27 shown in FIG. 6 for every prescribed control period (for example, 5 ms could be used as the prescribed control period).

More specifically, the steering control unit 2 instructs the operation portion 7 to calculate the target steering angle $\theta_{s*}$. Receiving this instruction, the operation portion 7 calculates the target steering angle $\theta_{s*}$ from the target steering angle variation $\Delta\theta_{s*}$ proportional to the steering wheel rotational angle variation $\Delta\theta_h$ as described below.

First, the operation portion 7 computes a steering wheel angular speed $\theta'_h$ based on a detection signal of the steering wheel angular speed sensor (step S21), and calculates the steering wheel rotational angle variation $\Delta\theta_h$ ($=\int\theta'_h$) by integrating the steering wheel angular speed $\theta\zeta_h$ over time (step S22).

Next, the operation portion 7 reads out and sets a steering angle ratio K corresponding to a present watercraft speed (for example, K=1/24) from the steering angle ratio memory 6, (step S23), and calculates the target steering angle variation $\Delta\theta_{s*}$ ($=K\cdot\Delta\theta_h$) by multiplying the steering wheel rotational angle variation $\Delta\theta_h$ by the steering angle ratio K (step S24).

Finally, the operation portion 7 reads out the target steering angle $\theta_{s*-1}$ in a preceding control period from the control data memory 5, adds the target steering angle variation $A\theta_{s*}$ to the target steering angle $\theta_{s*-1}$, and obtains a present target steering angle $\theta_{s*}$ ($=\theta_{s*-1}+\Delta\theta_{s*}$) (step S25). Further, the operation portion 7 stores the present target steering angle $\theta_{s*}$ in the control data memory 5 as $\theta_{s*-1}$ for the next steering control. However, there is no steering control in a preceding control period in the first steering control operation, and thus the target steering angle $\theta_{s*}$ cannot be calculated. Therefore, this step (step S25) is skipped in the first steering control operation.

When the target steering angle $\theta_{s*}$ is calculated as described above, the steering control unit 2 instructs the steering device operating portion 9 to make a steering operation of the outboard motor main body 27 based on the target steering angle $\theta_{s*}$ (step S26). Receiving this instruction, the steering device operating portion 9 appropriately operates the steering device operating system 28, and thereby steers the outboard motor main body 27 in a manner such that the actual steering angle $\theta_s$ corresponds to the target steering angle $\theta_{s*}$ (step S27). However, the instruction on the steering operation to the outboard motor main body 27 is not output in the first steering control since the target steering angle $\theta_{s*}$ has not been calculated as described above. Accordingly, the steering operation of the outboard motor main body 27 is not made in the first steering control.

The steering control method composed of a series of the steps (steps S21 through S27) is repeated. Accordingly, the steering operation of the outboard motor main body 27 is continuously executed.

As described above, only the method for computing the steering wheel rotational angle variation $\Delta\theta_h$, other than the control steps, is different in the second preferred embodiment when compared to the above first preferred embodiment. As a result, when the steering wheel 23 is not turned, the steering wheel rotational angle variation $\Delta\theta_h$ is zero, and the target steering angle variation $\Delta\theta_{s*}$ is also zero. Accordingly, the outboard motor main body 27 is not steered.

Therefore, if only one of the steering wheel 23 or the outboard motor main body 27 turns in a state where the power supply is turned off, a circumstance that the steering wheel 23 and/or the outboard motor main body 27 suddenly turn to prescribed positions as soon as the power supply is turned on when the watercraft 20 is started is prevented so that the rider will not feel uncomfortable. Furthermore, in the case where the watercraft 20 includes two operating stations 22 and steering wheel rotational angles $\theta_h$ of both the operating stations 22 differ from each other, a circumstance that the outboard motor main body 27 is suddenly steered immediately after a change between the operating stations 22 can be prevented so that the rider will not feel uncomfortable.

Third Preferred Embodiment

FIGS. 7 through 10 show a third preferred embodiment of the present invention.

Figure 7:
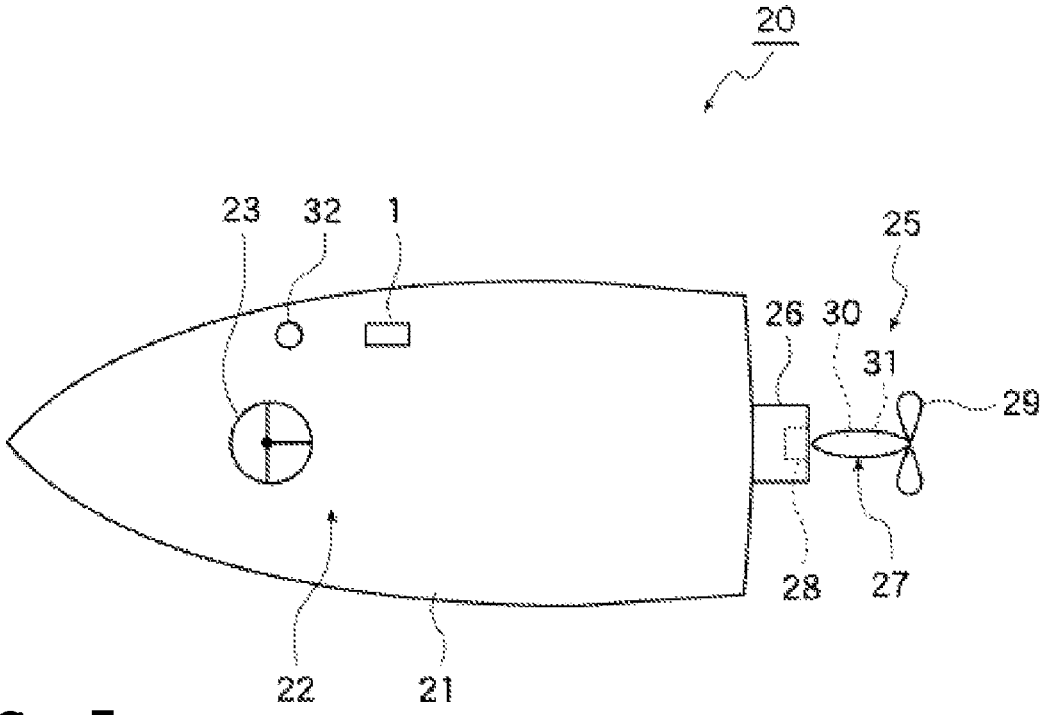
FIG. 7 is a plan view showing a watercraft in accordance with the second preferred embodiment of the present invention.

First, a construction of the third preferred embodiment of the present invention will be described. As shown in FIG. 7, the watercraft 20 includes the hull 21. The operating station 22 is provided at a general center of the hull 21. The steering wheel 23 is rotatably supported in the operating station 22 in the clockwise and the counterclockwise direction. A steering wheel angular speed sensor 32, such as an encoder, is mounted on the steering wheel 23. The outboard motor 25 is removably mounted on the rear portion of the hull 21. The outboard motor 25 is provided with the bracket 26, the outboard motor main body 27 as a propulsion unit, and the steering device operating system 28, such as a steering motor. The bracket 26 is fixed to the rear portion of the hull 21. The outboard motor main body 27 is supported by the bracket 26 in a manner such that it is steered to the right or left around the steering shaft and thereby a direction of propulsion can be changed. Further, the outboard motor main body 27 is provided with the engine 30, the drive transmission mechanism 31, and the propeller 29. Driving force of the engine 30 is transmitted to the propeller 29 via the drive transmission mechanism 31 thereby rotating the propeller 29, and a propulsive force is generated. An electric steering mechanism is provided on the watercraft 20. The steering wheel 23 and the steering device operating system 28 are electrically connected together.

Figure 8:
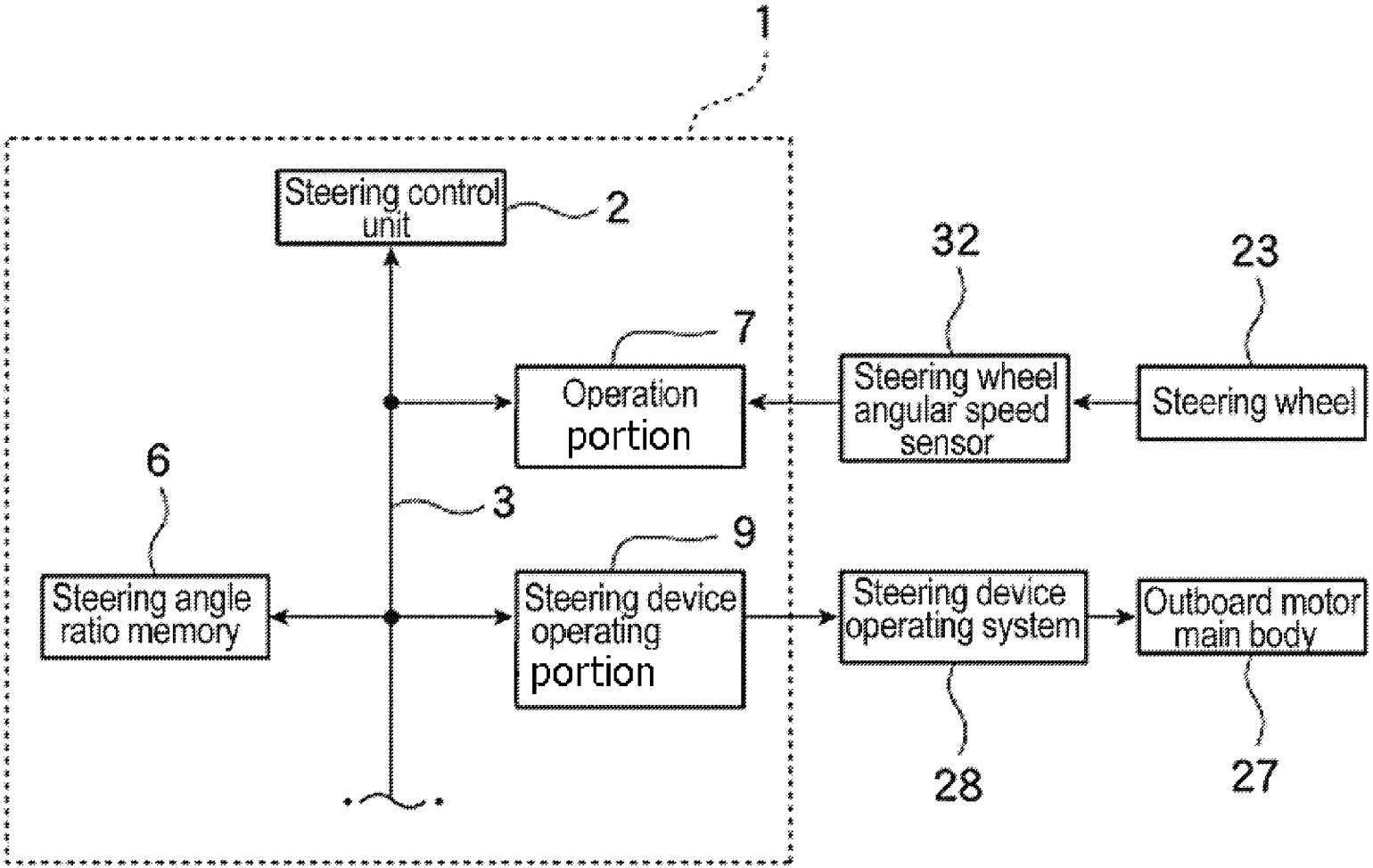
FIG. 8 is a control block diagram showing a steering control device in accordance with the second preferred embodiment of the present invention.
Figure 9:
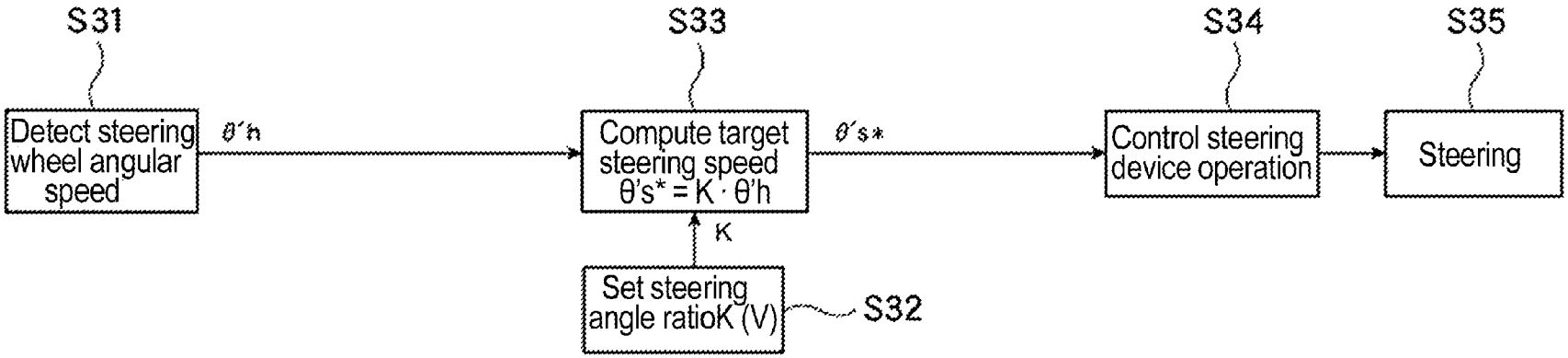
FIG. 9 is a flowchart showing a steering control method in accordance with a third preferred embodiment of the present invention.

As shown in FIG. 7, the steering control device 1 is installed on the watercraft 20. As shown in FIG. 8, the steering control device has the steering control unit 2 such as a CPU (Central Processing Unit). The steering angle ratio memory 6, the operation portion 7, and the steering device operating portion 9 are connected to the steering control unit 2 via the bus line 3. The steering angle ratio memory 6 stores the steering angle ratio K such that the steering angle ratio K can be read out in response to the watercraft speed. Furthermore, the steering wheel angular speed sensor 32 is connected to the operation portion 7. The steering device operating system 28 is connected to the steering device operating portion 9.

Next, operation of the third preferred embodiment of the present invention will be described.

A rider of the watercraft appropriately turns the steering wheel 23 at the operating station 22 when the rider operates the watercraft 20 having the above construction. Then, the steering control unit 2 executes a steering control while following steps S31 through S35 shown in FIG. 9 for every prescribed control period (for example, 5 ms could be used as the prescribed control period).

More specifically, the steering control unit 2 instructs the operation portion 7 to calculate a target steering speed $\theta'_{s*}$. Receiving this instruction, the operation portion 7 calculates the target steering speed $\theta'_{s*}$ as described below.

First, the operation portion 7 computes the steering wheel angular speed $\theta'_h$ based on a detection signal of the steering wheel angular speed sensor 32 (step S31). The operation portion 7 reads out and sets the steering angle ratio K corresponding to a present watercraft speed (for example, K=1/24) from the steering angle ratio memory 6 (step S32). Next, the operation portion 7 calculates the target steering speed $\theta'_{s*}$ ($=K\cdot\theta'_h$) by multiplying the steering wheel angular speed $\theta'_h$ by the steering angle ratio K (step S33).

When the target steering speed $\theta'_{s*}$ is calculated as described above, the steering control unit 2 instructs the steering device operating portion 9 to make a steering operation at the target steering speed $\theta'_{s*}$ (step S34). Receiving this instruction, the steering device operating portion 9 appropriately operates the steering device operating system 28. Thereby, the steering device 27 is steered such that the actual steering speed $\theta'_s$ corresponds to the target steering speed $\theta'_s$ (step S35).

The target steering speed $\theta'_{s*}$ is set in proportion to the steering wheel angular speed $\theta'_h$ as described above, and thus the steering device 27 is steered in response to a rotational speed of the steering wheel 23 independently of a position (rotational angle) of the steering wheel 23. As a result, when the steering wheel 23 is not turned, the steering wheel angular speed $\theta'_h$ is zero, and the target steering speed $\theta'_{s*}$ is zero since it is proportional to the steering wheel angular speed $\theta'_h$. Accordingly, the steering device 27 is not steered.

Therefore, if either the steering wheel 23 or the outboard motor main body 27 turns in the state that the power supply is turned off, a circumstance that the steering wheel 23 and/or the outboard motor main body 27 suddenly turn to prescribed positions just as power supply is turned on when the watercraft 20 is started can be prevented so that the rider will not feel uncomfortable.

More specifically, for example, in the case where the outboard motor main body 27 has not been steered, the steering wheel 23 has been turned, and the steering wheel rotational angle $\theta_h$ has become $\theta_1$ in the state that the power supply is turned off (the state before starting) as indicated in FIG. 4A, if the power supply is turned on at time $t_1$ and the watercraft is started as indicated in FIG. 4C, the steering wheel rotational angle $\theta_h$ is retained at $\theta_1$ and the steering wheel does not suddenly turn. Therefore, a circumstance that the steering wheel 23 suddenly turns as soon as the power supply is turned on can be prevented so that the rider will not feel uncomfortable. In the case that the steering wheel 23 has not been turned, the outboard motor main body 27 is turned, and the actual steering angle $\theta_s$ has become $\theta_3$ in the state that the power supply is turned off (the state before starting) as indicated in FIG. 4B, if the power supply is turned on at time $t_1$ and the watercraft 20 is started as indicated in FIG. 4C, the actual steering angle $\theta_s$ is retained at $\theta_3$, and the outboard motor main body 27 is not suddenly steered. Therefore, a circumstance that the outboard motor main body 27 is suddenly steered as soon as the power supply is turned on when the watercraft 20 is started can be prevented so that the rider will not feel uncomfortable.

Furthermore, in the case where the watercraft 20 includes two operating stations 22 and steering wheel rotational angles $\theta_h$ of both the operating stations 22 differ from each other, a circumstance that the outboard motor main body 27 is suddenly steered immediately after a change between the operating stations 22 can be prevented so that the rider will not feel uncomfortable.

More specifically, for example, in the case where the steering wheel rotational angle $\theta_h$ of the first operating station is $\theta_5$ and the steering wheel rotational angle $\theta_h$ of the second operating station is $\theta_6$ ($<\theta_5$) as indicated in FIG. 5B, even if an active operating station is changed from the first operating station to the second operating station at time $t_2$ and the control systems are changed as indicated in FIG. 5A, the actual steering angle $\theta_s$ is retained at $\theta_7$ and the outboard motor main body 27 is not suddenly steered as indicated in FIG. 5C. Therefore, a circumstance that the outboard motor main body 27 is suddenly steered immediately after a change between the operating stations 22 and that the rider of the watercraft feels uncomfortable is prevented.

Furthermore, in the case where a watercraft speed is changed in the watercraft 20 having the steering angle ratio varying function, a circumstance that a steering angle corresponding to a counter-steering is suddenly changed can be prevented so that the rider will not feel uncomfortable.

Figure 10A:
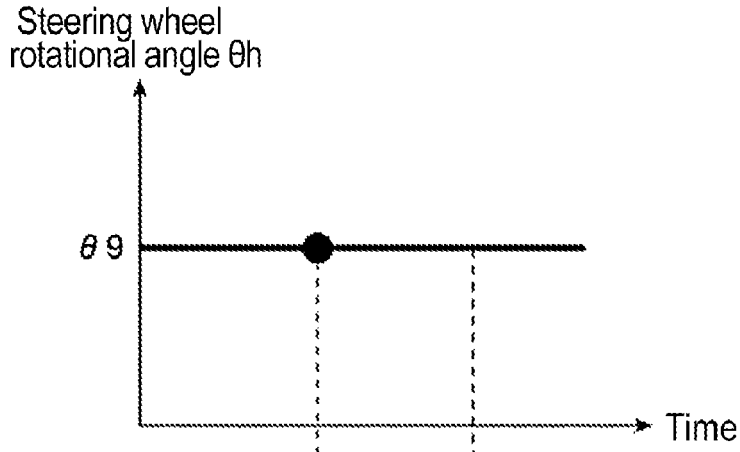
Figure 10B:
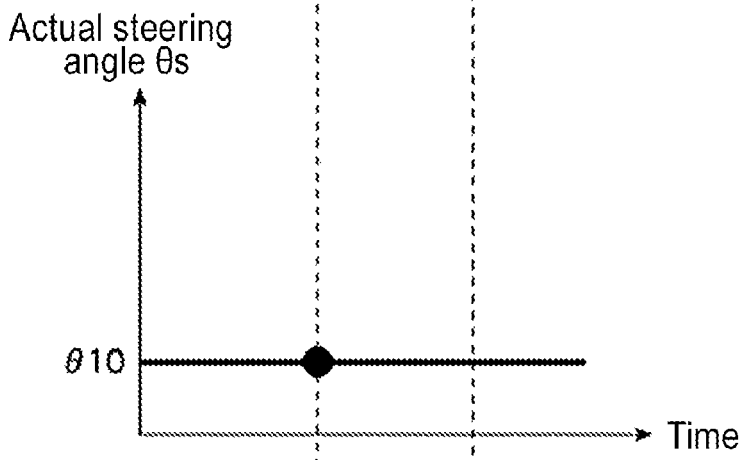
Figure 10C:
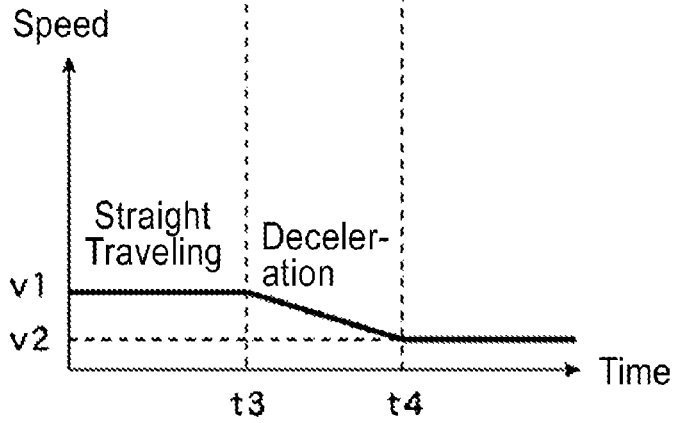
Figure 11:
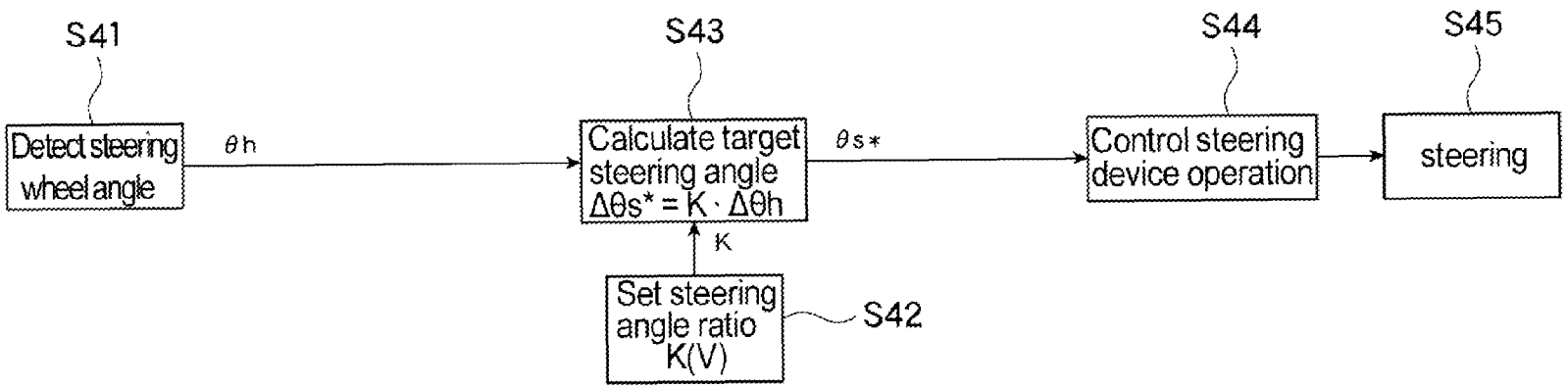
FIG. 11 is a flowchart showing an exemplarily steering control method.
Figure 12A:
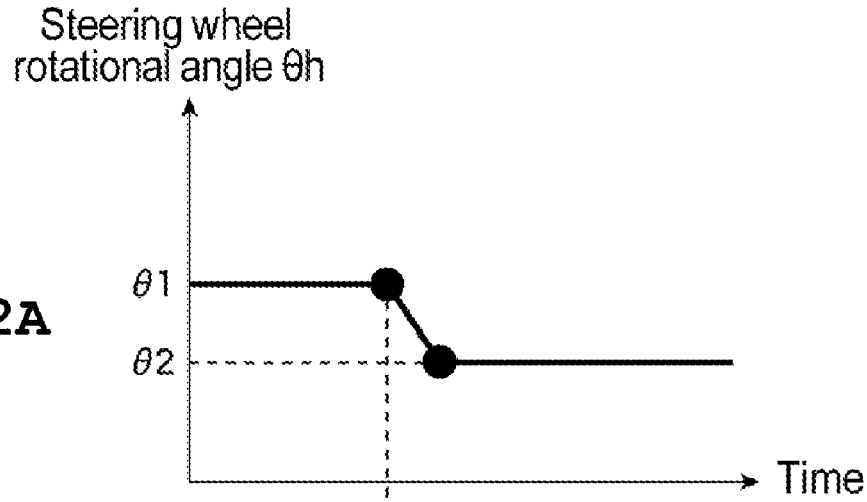
Figure 12B:
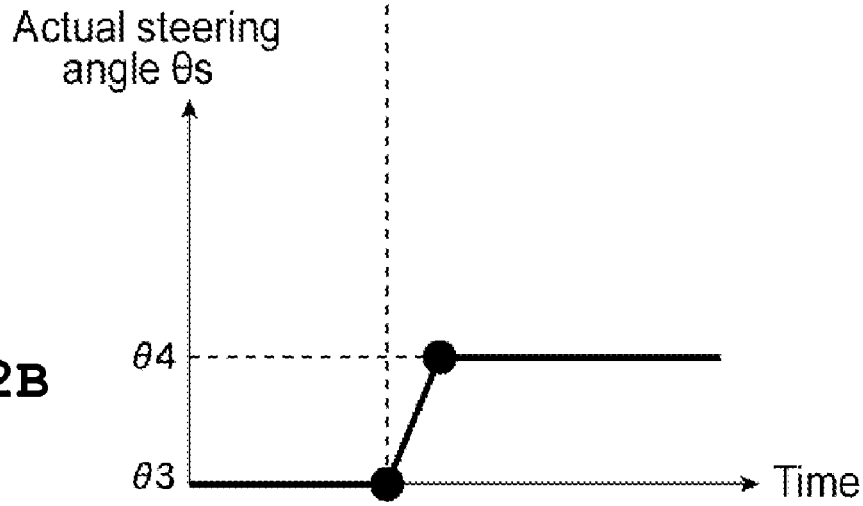
Figure 12C:
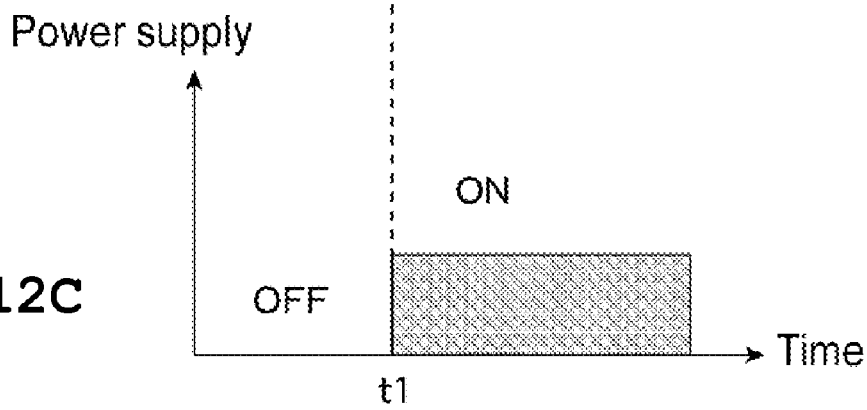
Figures 13A, 13B, 13C:
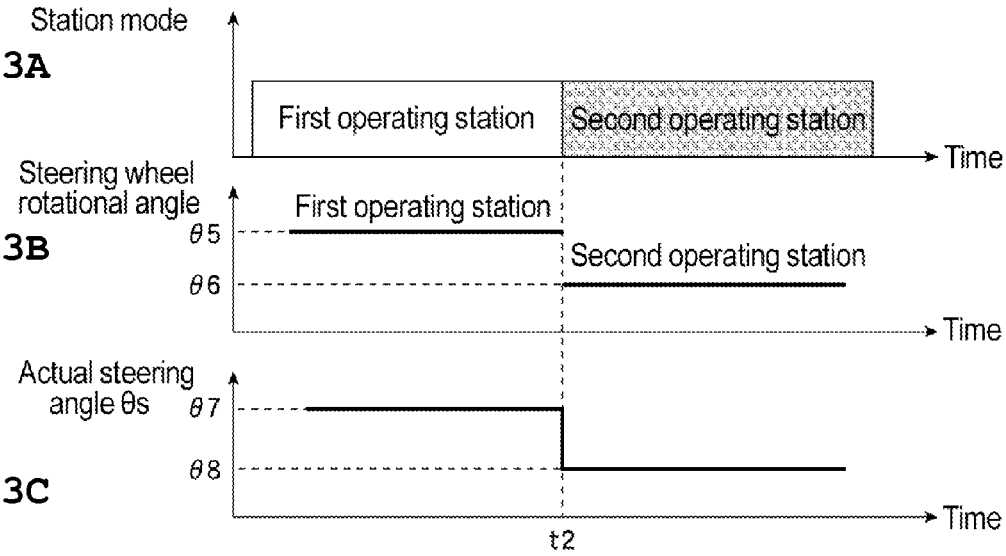
Figure 14A:
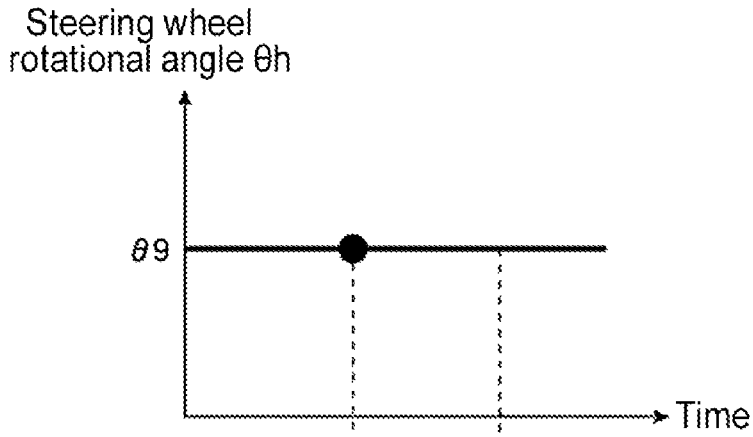
Figure 14B:
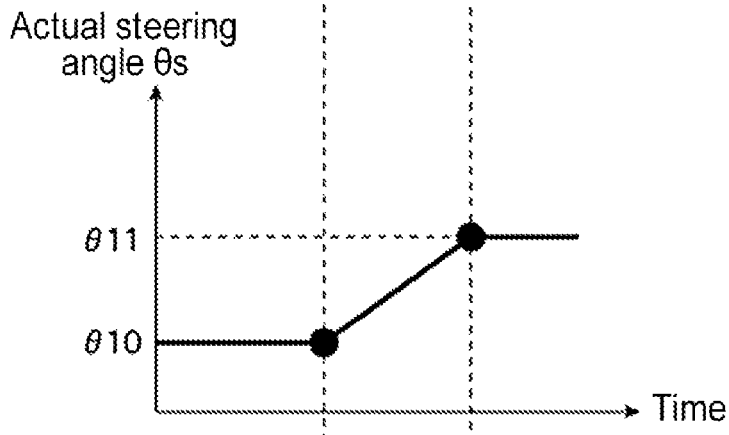
Figure 14C:
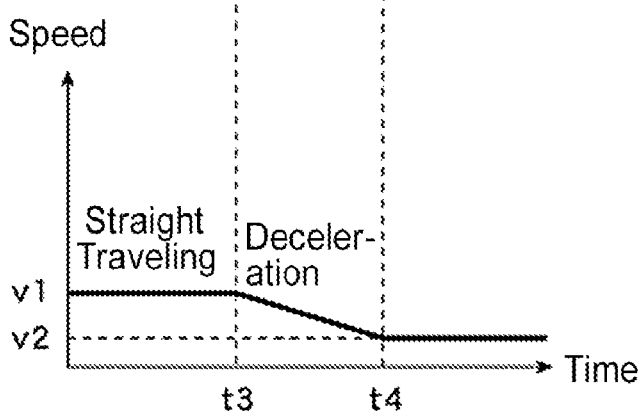

More specifically, for example, in the case where the watercraft traveling at a constant speed $v_1$ starts decelerating at time $t_3$, attains a speed $v_2$ at time $t_4$ to finish deceleration, and thereafter travels at a constant speed $v_2$ as indicated in FIG. 10C, the actual steering angle $\theta_s$ is retained at $\theta_{10}$ after deceleration starting time $t_3$ as indicated in FIG. 11B and the outboard motor main body 27 is not suddenly steered if the steering wheel rotational angle $\theta_h$ is retained at a constant value $\theta_9$ through all steps of the traveling as indicated in FIG. 11A. Similarly, the outboard motor main body 27 is not suddenly steered while the watercraft is accelerating. Accordingly, a circumstance where a steering angle corresponding to a counter-steering increases or decreases can be prevented so that the rider will not feel uncomfortable.

Other Preferred Embodiments

In the first preferred embodiment, description is made about a case where the steering wheel rotational angle variation $\Delta\theta_h$ is preferably calculated by using two data including a present steering wheel rotational angle $\theta_{h1}$ and a steering wheel rotational angle $\theta_{h2}$ in a preceding control period in the calculation of the steering wheel rotational angle variation $\Delta\theta_h$. However, an average value $\theta_{h\,ave}$ of a plurality of steering wheel rotational angles in one or more previous control periods may be used instead of the steering wheel rotational angle $\theta_{h2}$ in the preceding control period.

In the above third preferred embodiment, description is made about a case that the steering wheel angular speed $\theta'_h$ is preferably computed based on a detection signal of the steering wheel angular speed sensor 32. However, the steering wheel rotational angle sensor 24 (shown in FIG. 1) may be used instead of the steering wheel angular speed sensor 32. The steering wheel rotational angle variation $\Delta\theta_h$ is preferably computed based on a detection signal of the steering wheel rotational angle sensor, and thereby the steering wheel angular speed $\theta'_h$ may be calculated based on the steering wheel rotational angle variation $\Delta\theta_h$.

More specifically, the operation portion 7 first calculates a steering wheel angular speed variation $\Delta\theta'_h$ by differentiating the steering wheel rotational angle variation $\Delta\theta_h$ over time. Next, the operation portion 7 calculates the steering wheel angular speed $\theta'_h$ by adding the steering wheel angular speed variation $\Delta\theta'_h$ to a steering wheel angular speed in a preceding control period. Finally, the operation portion 7 calculates the target steering speed $\theta'_{s*}$ ($=K\cdot\theta'_h$) by multiplying the steering wheel angular speed $\theta'_h$ by the steering angle ratio K.

In this case, only the method for computing the steering wheel angular speed $\theta'_h$ is different compared to the above third preferred embodiment, but control steps after this computation are the same. As a result, while the steering wheel 23 is not turned, the steering wheel angular speed $\theta'_h$ is zero, and the target steering speed $\theta's^*$ is zero since it is proportional to the steering wheel angular speed $\theta'_h$. Accordingly, the steering device 27 is not steered. Therefore, in the case where only one of the steering wheel 23 or the outboard motor main body 27 is turned in the state that the power supply is turned off, that the watercraft 20 includes two operating stations 22 and steering wheel rotational angles $\theta_h$ of both the operating stations 22 differ from each other, and further in the case that the steering angle ratio varying function is installed on the watercraft 20 and a watercraft speed is changed, a circumstance that the rider of the watercraft feels uncomfortable can be prevented.

It has been described that the preferred embodiments of the present invention work effectively in a change between the two operating stations 22 in the above first through third preferred embodiments. However, the same effects can be obtained in a change among three or more operating stations 22. It should be noted that the same effects as in a change among the operating stations 22 can be obtained when the control systems are changed in cases other than changing the operating stations 22 such as when an automatic operation (auto-pilot) mode is canceled, and when a change is made from a remote control mode to a steering wheel operation mode.

Description has been made about the watercraft 20 in which the outboard motor 25 is preferably mounted on the hull 21 in the above first through third preferred embodiments. However, the preferred embodiments of the present invention can be applied to a watercraft in which a watercraft propulsion unit other than an outboard motor 25 (for example, an inboard/outboard motor, and the like) is mounted on the hull 21.

Description has been made about the outboard motor main body 27 as an example of a steering device in the above first through third preferred embodiments. It is also possible to apply the preferred embodiments of the present invention to a watercraft including a steering device other than the outboard motor main body 27 (for example, a rudder portion of an inboard/outboard motor, a rudder portion of a watercraft including an inboard motor, and the like).

The preferred embodiments of the present invention can be widely applied to various kinds of watercraft such as pleasure boats, small planing boats, and personal watercraft.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A steering control method for a watercraft including a steering wheel and a steering device electrically connected together, the method comprising the steps of:

storing a preceding steering wheel rotational angle in a memory;

computing a present steering wheel rotational angle of the steering wheel;

computing a steering wheel rotational angle variation of the steering wheel based on an amount of change of the present steering wheel rotational angle from the preceding steering wheel rotational angle stored in the memory in one or more control periods prior to the step of computing the present steering wheel rotational angle, and if the preceding steering wheel rotational angle stored in the memory corresponds to a steering wheel rotational angle of a first operating station on the watercraft and the present steering wheel rotational angle of the steering wheel corresponds to a steering wheel rotational angle of a second operating station on the watercraft, an actual steering angle of the steering device is retained at the preceding steering wheel rotational angle corresponding to the first operating station;

calculating a target steering angle based on the steering wheel rotational angle variation; and steering the steering device based on the target steering angle;

wherein if the preceding steering wheel rotational angle stored in the memory corresponds to a steering wheel rotational angle of a first operating station on the watercraft, and the present steering wheel rotational angle of the steering wheel corresponds to a steering wheel rotational angle of a second operating station on the watercraft, an actual steering angle of the steering device is retained at the preceding steering wheel rotational angle corresponding to the first operating station.

2. A steering control device for a watercraft including a steering wheel and a steering device electrically connected together, the steering control device comprising:

a memory arranged to store a steering wheel rotational angle;

a present steering wheel rotational angle computing device arranged to compute a present steering wheel rotational angle of the steering wheel;

a rotational angle variation computing device arranged to compute a steering wheel rotational angle variation of the steering wheel based on an amount of change of the present steering wheel rotational angle from a steering wheel rotational angle stored in the memory in one or more control periods before the present steering wheel rotational angle computing device computes the present steering wheel rotational angle;

a target steering angle computing device arranged to calculate a target steering angle based on the steering wheel rotational angle variation computed by the rotational angle variation computing device; and a steering device operating device arranged to steer the steering device based on the target steering angle calculated by the target steering angle computing device.

3. The steering control device according to claim 2, wherein the rotational angle variation computing device computes the steering wheel rotational angle variation by integrating steering wheel angular speed over time.

4. A watercraft comprising the steering control device according to claim 2.

5. The steering control method according to claim 1, further comprising the step of storing the 3resent steering wheel rotational angle in the memory.

6. The steering control method according to claim 1, wherein the amount of change of the present steering wheel rotational angle from the preceding steering wheel rotational angle is obtained by subtracting the preceding steering wheel rotational angle from the present steering wheel rotational angle.

7. The steering control method according to claim 1, wherein if a power supply to the watercraft is turned on and no preceding steering wheel rotational angle is stored in the memory, an actual steering angle of the steering device is retained at the present steering wheel rotational angle, and the present steering wheel rotational angle is stored in the memory.

8. The steering control device according to claim 2, wherein the memory is arranged to store the present steering wheel rotational angle.

9. The steering control device according to claim 2, wherein the rotational angle variation computing device computes the steering wheel rotational angle variation by subtracting the preceding steering wheel rotational angle from the present steering wheel rotational angle.

* * * * *